US011718511B2

(12) United States Patent
Alamome et al.

(10) Patent No.: US 11,718,511 B2
(45) Date of Patent: Aug. 8, 2023

(54) PIVOT-FORMING CRANE ELEMENT FOR AN ELEMENT-MOUNTED CRANE

(71) Applicant: MANITOWOC CRANE GROUP FRANCE, Dardilly (FR)

(72) Inventors: Grégory Alamome, Rillieux la Pape (FR); Cédric Fourier, Crottet (FR); Fabian Verguet, Francheville (FR)

(73) Assignee: MANITOWOC CRANE GROUP FRANCE, Dardily (FR)

( * ) Notice: Subject to any disclaimer, the term of this patent is extended or adjusted under 35 U.S.C. 154(b) by 0 days.

(21) Appl. No.: 17/480,082

(22) Filed: Sep. 20, 2021

(65) Prior Publication Data

US 2022/0098011 A1 Mar. 31, 2022

(30) Foreign Application Priority Data

Sep. 25, 2020 (FR) ..... 2009771

(51) Int. Cl.

| | |
|---|---|
| ***B66C 23/02*** | (2006.01) |
| ***B66C 23/26*** | (2006.01) |
| ***B66C 23/64*** | (2006.01) |
| ***B66C 23/84*** | (2006.01) |

(52) U.S. Cl.

CPC ..... *B66C 23/022* (2013.01); *B66C 23/26* (2013.01); *B66C 23/64* (2013.01); *B66C 23/84* (2013.01)

(58) Field of Classification Search

CPC ..... B66C 23/022; B66C 23/16; B66C 23/26; B66C 23/62; B66C 23/64; B66C 23/84

See application file for complete search history.

(56) References Cited

U.S. PATENT DOCUMENTS

| | | | | |
|---|---|---|---|---|
| 4,582,205 A * | 4/1986 | Berger | ..... | B66C 13/52 212/175 |
| 2007/0175849 A1* | 8/2007 | Yokoyama | ..... | B66C 23/82 212/180 |
| 2016/0031683 A1* | 2/2016 | Fen | ..... | B66C 13/40 212/276 |

FOREIGN PATENT DOCUMENTS

| | | | | |
|---|---|---|---|---|
| DE | 3510116 A1 | 10/1985 | | |
| EP | 384112 A * | 8/1990 | ..... | B66C 23/26 |
| EP | 0635450 A1 | 1/1995 | | |
| FR | 3046152 A1 | 6/2017 | | |

OTHER PUBLICATIONS

DE 3,510,116 A1 Machine Translation. (Year: 1985).*

(Continued)

*Primary Examiner* — Michael R Mansen
*Assistant Examiner* — Juan J Campos, Jr.
(74) *Attorney, Agent, or Firm* — Cook Alex Ltd.

(57) ABSTRACT

A pivot-forming crane element for a rotating portion of an element-mounted crane includes a framework on which a motor-driven orienting system, a hoisting winch and a dispensing winch are mounted. The motor-driven orienting system includes a pivot mechanism about an orienting axis and at least one orienting electric motor cooperating with the pivot mechanism to make the framework pivot about the orienting axis. The hoisting winch is provided with a hoisting electric motor cooperating with a hoisting drum around which a hoisting rope is wound. The dispensing winch is provided with a dispensing electric motor cooperating with a dispensing drum around which a dispensing rope is wound.

19 Claims, 4 Drawing Sheets

(56) References Cited

OTHER PUBLICATIONS

EP 0,384,112 A2 Machine Translation. (Year: 1990).*
Search Report and Written Opinion dated May 26, 2021 issued by the FR Patent Office (INPI) in connection with corresponding FR Pat. Appl. No. 20/09771.

* cited by examiner

PIVOT-FORMING CRANE ELEMENT FOR AN ELEMENT-MOUNTED CRANE

FIELD

The present disclosure relates to a pivot-forming crane element for a rotating portion of an element-mounted crane. The pivot-forming crane element, also referred to as a «pivot», forms the element of the crane that pivots at the top of the mast, and which carries the jib along which a dispensing trolley moves, which, in turn, supports a hoisting reeve-block on which a load to be displaced is hooked; the jib and the mast being also composed by several elements assembled together. Where appropriate, this pivot-forming crane element could also carry a counter-jib which forms another element of the crane, and which conventionally supports one or several counterweight(s).

An element-mounted crane, such as a top-slewing crane, may be recognized as having several advantages, including the possibility to adapt to the work environment, whether on a construction site at height, a cumbersome construction site or a wide construction site, and the amplitude of the movements to lift and dispense heavy loads.

BACKGROUND

Conventionally, numerous functional components (winches and motors, command/control unit, safety devices, sensors, . . . ) are integrated to the different structural elements of the crane, including the hoisting winch which is generally mounted on the counter-jib forming crane element or on the jib-foot forming crane element (this element forming the first element of the jib to be mounted on the pivot), the dispensing winch which is conventionally mounted on the jib-foot forming crane element and the motor-driven orienting system which is mounted on the pivot-forming crane element.

For example, the document EP 0 635 450 A1 describes an element-mounted crane wherein both the hoisting winch and the dispensing winch are mounted on the jib-foot forming crane element.

These functional components are mounted in the factory on the structural elements of the crane to form crane elements with one or several functions. These crane elements are deemed equivalent to packages that are transported, handled and assembled afterwards on the construction site to form the mast the rotating portion (pivot, jib and possibly counter-jib) of the crane.

Hence, the number of mechanical interfaces is high, since each motor set (motor-driven orienting system, hoisting winch and dispensing winch) is equipped with its own support, to hold and guide the mechanical and electromechanical components that compose it, and this support is, in turn, provided with mounting and setting interfaces for mounting thereof on the concerned structure element.

Moreover, the dispersal of the functional components on the different structural elements, and thus the distancing of these functional components, therefore increases the number of mechanical interfaces (for example screwed, axis-aligned or pin-aligned type interfaces) and of electrical interfaces (for example connector, electrical socket or other electrical connections) to mechanically and electrically connect the functional components to one another, and also increases the dimensions and the lengths of cables for connection with the command/control unit, in particular for the sensors and the electric power supply of the motors. In addition, this dispersal of the functional components complicates and lengthens the duration of assembly of the crane elements, since it requires, in addition to the mechanical and structural connections, ensuring the electrical connections between the crane elements.

Also, this modular conventional architecture has limitations whether for logistics of manufacture, the large number of parts to be supplied, the operations of setting, mounting and connecting the functional components, the used amount of materials, in particular the copper of the cables, the mount/dismount operations and finally the reliability by the multiplication of parts and interfaces.

The state of the art is also illustrated by the teachings of the document DE 35 10 116 A1, or of its French equivalent FR 2 565 950 A1, which suggests mounting the hoisting winch and the dispensing winch on a portion of the jib, forming a jib foot, which is secured to the pivot, and wherein the dispensing winch is disposed above the hoisting winch, which is, in turn, disposed above the dispensing trolley. Thus, such a solution allows grouping these two winches on a portion secured to the pivot, but it turns out to barely suited, since these two winches are located just above the dispensing trolley when the latter is brought at the jib foot, which is constraining for routing the cables.

SUMMARY

The present disclosure aims at solving all or part of the aforementioned drawbacks, by considering a reduction of the number of mechanical and electrical interfaces between the different crane elements of an element-mounted crane.

Another object of the present disclosure is to provide a solution to simplify mounting of the hoisting winch and of the dispensing winch, including the routes of the associated hoisting rope and dispensing rope.

To this end, the embodiments of the present disclosure provide a pivot-forming crane element for a rotating portion of an element-mounted crane, this pivot-forming crane element comprising a framework on which are mounted:

- a motor-driven orienting system comprising a pivot mechanism about an orienting axis and at least one orienting electric motor cooperating with said pivot mechanism to make the framework pivot about the orienting axis;
- a hoisting winch provided with a hoisting electric motor cooperating with a hoisting drum around which a hoisting rope is wound;
- a dispensing winch provided with a dispensing electric motor cooperating with a dispensing drum around which a dispensing rope is wound;

wherein the framework comprises a frame and a truss projecting from said frame to form a jib carrier, wherein all of the motor-driven orienting system, the hoisting winch and the dispensing winch are mounted on the frame; and said frame has:

- a central portion on which the motor-driven orienting system and the truss are mounted; and
- a front portion extending the central portion forwards beyond the truss, and on which the hoisting winch and the dispensing winch are mounted;

wherein the front portion of the pivot-forming crane element comprises an upper bed on which the hoisting winch is mounted, and below which the dispensing winch is mounted, so that the hoisting winch is disposed above the dispensing winch.

Thus, the present disclosure suggests mounting, on the framework of a pivot-forming crane element, the three main motor sets (motor-driven orienting system, hoisting winch and dispensing winch) of a crane, thereby allowing reducing the electrical interfaces to a minimum, therefore allowing for a time saving during manufacture in the factory, in particular for mounting and wiring operations, and also for a time saving and for easy operations of assembling the crane elements on the construction site. The present disclosure also allows for an increase in the reliability of the crane, with a reduction of the risk of breakdowns, in particular those related to humidity, since less cable connections will be necessary.

Moreover, the present disclosure allows electrically testing the three motor sets, in the factory and directly on the pivot-forming crane element, without having to assemble the crane, even partially, which allows making the defects or breakdowns detection tests reliable. In other words, the present disclosure allows carrying out a final test of the wired motor sets in the final version, and thus reducing the problems of reliability upon first start-up of a new crane.

Another object that is achieved with the present disclosure is to reduce the number of parts to be manufactured, such as the supports of the motor sets and their interfaces as well as the sockets for connection with the command/control unit, and also to reduce the amounts of cables to be installed.

The present disclosure also allows designing a framework of the pivot-forming crane element that will receive the three main motor sets, which may have the advantage of allowing machining, in one operation, on a machining center and on the same framework, the different surfaces or supports (bearings, bearing surfaces, etc.) necessary to the three motor sets, which allows avoiding quite many manipulations and settings that are necessary in a conventional modular architecture, not to mention the reduction of the number of critical high-accuracy dimensions.

Moreover, maintenance of the three motor sets is facilitated since it is no longer necessary to get on the jib-foot forming crane element to access the dispensing winch or the hoisting winch, or on the counter-jib forming crane element to access the hoisting winch. Thus, access to the dispensing winch and to the hoisting winch is possible via a type-1 access (crane operator access) without the need for a harness, thereby allowing for more ease and time saving in maintenance.

Furthermore, the positioning of the dispensing winch on the pivot-forming crane element (instead of the jib-foot forming crane element as is conventionally the case) allows reducing the dead weight on the jib-foot forming crane element and thus increasing the payload, which contributes to an improvement of the load curve of the crane.

It should be noted that the arrangement of the hoisting winch and of the dispensing winch one above the other may be particularly advantageous in terms of compactness. Moreover, by being placed below the hoisting winch, the dispensing winch replaces the deflection pulley of the dispensing rope, which is generally located at the jib foot in conventional cranes. Hence, this arrangement allows getting rid of a pulley on the dispensing cable route and at the departure of the dispensing cables (front side of the trolley and rear side of the trolley) is done in the same direction (forwards).

Moreover, it would be possible to carry out all dimensioning and machining necessary to the three motor sets (motor-driven orienting system, hoisting winch and dispensing winch) on the same frame, thereby allowing for an easy and reliable manufacturing.

In addition, the hoisting winch and the dispensing winch are disposed on the front portion of the frame, while the motor-driven orienting system and the truss are provided on the central portion, thereby allowing for compactness.

In one embodiment, the front portion of the frame does not have any rail for a dispensing trolley, so that said front portion does not constitute a jib element.

In other words, the pivot-forming crane element does not integrate any jib element or portion that could carry a dispensing trolley, so that, in any case, the hoisting winch and the dispensing winch are carried on a jib element (or a jib-foot forming portion), but are carried only on the pivot-forming crane element and are thus necessarily remote from the dispensing trolley, irrespective of the position of this dispensing trolley.

According to another possibility, the truss supports a jib top attachment and the front portion of the frame supports a jib low attachment.

Thus, in the assembled crane, the jib is fastened on both the truss, at the level of the jib top attachment, and the front portion of the frame, at the level of the jib low attachment.

In one embodiment, the hoisting drum and the dispensing drum are rotatable about parallel or substantially parallel axes.

In the context of this disclosure, by «substantially parallel» axes, it should be understood axes that are inclined with respect to one another with an angle smaller than or equal to 10 degrees.

In some embodiments, the truss supports an upper rope deflection system, such as for example an upper pulley, disposed above and at the rear of the hoisting winch for a first deflection of the hoisting rope, and the front portion of the frame supports a lower rope deflection system, such as for example a lower pulley, disposed below and at the rear of the hoisting winch for a second deflection of the hoisting rope.

Such an architecture may be advantageous because it enables the hoisting rope to circumvent the dispensing winch without any hindrance.

In one embodiment, at least one amongst the upper rope deflection system and the lower rope deflection system is coupled to a load measuring sensor to measure a load at the level of the hoisting rope.

Thus, thanks to these rope deflection systems, it is possible to integrate such a load measuring sensor on the pivot-forming crane element, thereby adding a new function at the level of this element and therefore contributing to reducing interfaces even more.

In one embodiment, the frame has a rear portion extending the central portion rearwards beyond the truss, and the truss supports a counter-jib top attachment and the rear portion of the frame supports a counter-jib low attachment.

Thus, in the assembled crane, the counter-jib is fastened on both the truss, at the level of the counter-jib top attachment, and the rear portion of the frame, at the level of the counter-jib low attachment.

According to one possibility, the framework has at least one first bearing on which the hoisting drum is rotatably mounted, and at least one second bearing on which the dispensing drum is rotatably mounted.

In other words, these two bearings are provided and machined directly on the framework, which allows reducing mechanical interfaces and carrying out almost all of the necessary machining operations on the same part, namely the framework.

The present disclosure also concerns the feature according to which the pivot-forming crane element comprises an electric set mounted on the framework and integrating at least one command/control unit, a power supply interface to plug an electric power supply, and a network of electrical cables connecting the command/control unit and the power supply interface to the orienting electric motor, to the hoisting electric motor and to the dispensing electric motor.

Thus, the pivot-forming crane element integrates such an electric set, with a command/control unit present on the framework and directly connected to the three motor sets (motor-driven orienting system, hoisting winch and dispensing winch), reducing the electrical interfaces, the lengths of cables, the electrical mounting times, and facilitating electrical maintenances, etc.

Moreover, in this version, the present disclosure allows making in the factory, and directly on the pivot-forming crane element, not only wired motor sets, but also the aforementioned electric set, which comprises at least the command/control unit, the power supply interface and the network of electrical cables, and possibly also the sensor(s) or the safety device(s) as described hereinafter (anemometer, hoisting safety device, dispensing safety device).

According to one possibility, the pivot-forming crane element comprises at least one anemometer mounted on the framework, adding another function directly on the pivot-forming crane element.

According to one variant, a hoisting safety device, such as a top or bottom end-of-travel, is disposed on the hoisting winch to secure the travel of the hoisting rope.

According to one variant, a dispensing safety device, such as a front or rear end-of-travel, is disposed on the dispensing winch to secure the travel of the dispensing rope.

Whether it is the anemometer, the hoisting safety device or the dispensing safety device, each is intended to be connected to the command/control unit of the crane. Also, if the command/control unit is present on the pivot-forming crane element as described hereinabove (or alternatively on the transportable package as described hereinafter), then the wirings between these devices and the command/control unit will be easy and reliable as they are direct.

In one embodiment, the pivot mechanism comprises a fixed pivot intended to be securely fastened to the top of a mast, and a rotating pivot rotatably coupled to the fixed pivot about the orienting axis.

According to one possibility, the fixed pivot includes an orienting crown which is geared, the rotating pivot has an annular bearing surface provided on the underside of the framework and bearing on the orienting crown, and the at least one orienting electric motor is provided with a pinion meshing with the orienting crown.

The present disclosure also concerns a transportable package for a rotating portion of an element-mounted crane, said transportable package comprising:

- a pivot-forming crane element according to embodiments herein, and
- a main crane element, selected amongst a counter-jib forming crane element and a jib-foot forming crane element, fastened on the framework of the pivot-forming crane element.

According to one possibility, the main crane element is securely fastened on the framework of the pivot-forming crane element, for example by welding.

Thus, it could be considered to form a transportable package comprising the pivot-forming crane element on which the counter-jib forming crane element is fastened (for example permanently, in particular by welding), or alternatively a transportable package comprising the pivot-forming crane element on which the jib-foot forming crane element is fastened (for example permanently, in particular by welding).

Thus, such a transportable package, according to either one of the two possibilities, could be assembled, equipped, wired and tested on the ground, directly in the factory, before being loaded and transported with the other elements such as the mast elements and the jib elements.

An advantage which may be conferred by the transportable package comprising the pivot-forming crane element on which the jib-foot forming crane element is fastened, consists in potentially enabling the set-up of the dispensing trolley on the ground, and thus improving the ergonomics and safety of the operation of installing the dispensing trolley and passage of the hoisting rope.

In an embodiment, the transportable package comprises an electric set mounted on the main crane and integrating at least one command/control unit, a power supply interface to plug an electric power supply, and a network of electrical cables connecting the command/control unit and the power supply interface to the orienting electric motor, to the hoisting electric motor and to the dispensing electric motor.

Hence, this embodiment is a variant of the previously-described embodiment, wherein the electric set is mounted on the framework of the pivot-forming crane element. Nevertheless, this embodiment may have the same advantages, for example, in enabling carrying out in the factory, and directly on the transportable package (before transport thereof), a final test not only of the wired motor sets, but also of the electric set, which comprises at least the command/control unit, the power supply interface and the network of electrical cables, but also the sensor(s) or safety devices as described hereinbefore.

The present disclosure also relates to a transportable package as described hereinabove, and further comprising a secondary crane element, selected amongst the counter-jib forming crane element and the jib-foot forming crane element and which is not the main crane element, detachably fastened on the framework of the pivot-forming crane element.

The present disclosure also concerns an element-mounted crane comprising a rotating portion as described hereinabove, and a mast provide with a top on which the framework of the pivot-forming crane element is mounted.

According to one possibility, the element-mounted crane comprises:

- a jib provided with the jib-foot forming crane element fastened on the framework of the pivot-forming crane element;
- a dispensing trolley hanging on the jib and linked to the dispensing winch (for reminder, mounted on the pivot-forming crane element) via the dispensing rope for a displacement of the dispensing trolley along the jib in opposite forward direction and backward direction;
- a reeve-block hanging from the dispensing trolley by the hoisting rope coupled to the hoisting winch (for reminder, mounted on the pivot-forming crane element) for an ascending and descending displacement of the reeve-block.

BRIEF DESCRIPTION OF THE DRAWINGS

Other features and advantages of the present invention will appear upon reading the detailed description hereinafter, of a non-limiting example of implementation, made with reference to the appended figures wherein.

DESCRIPTION

Figure 3:
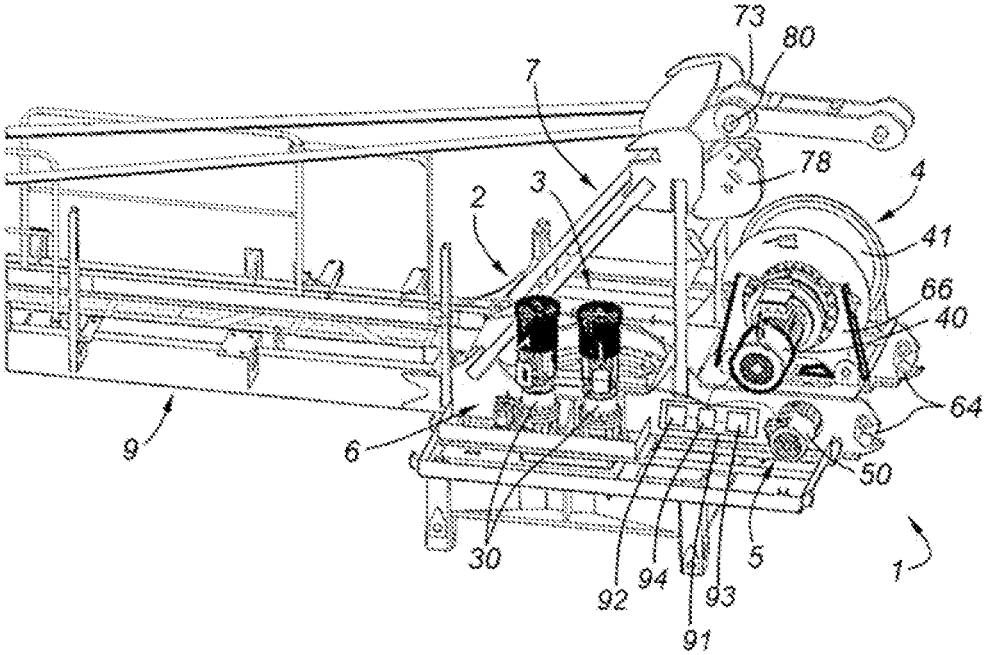
FIG. 3 is a schematic perspective top view of a pivot-forming crane element according to an embodiment, comprising the framework of FIGS. 1 and 2, as well as a hoisting winch and a dispensing winch, where a counter-jib forming crane element is securely fastened on the framework of this pivot-forming crane element.
Figure 4:
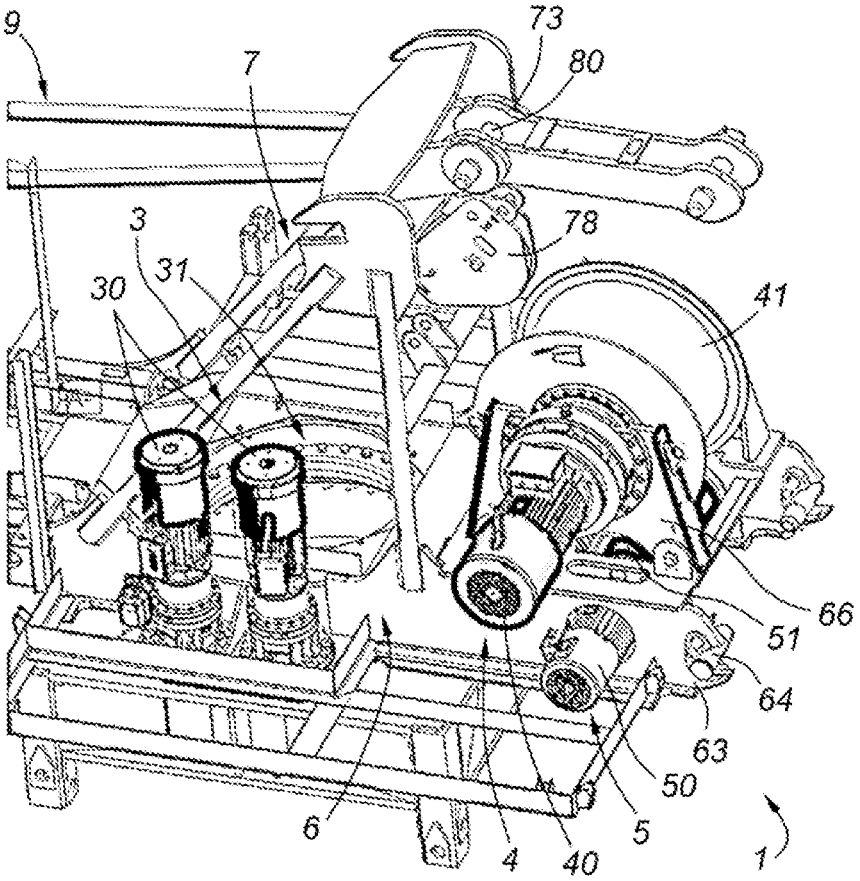
FIG. 4 is a schematic perspective top view of the pivot-forming crane element of FIG. 3.

Referring to FIGS. 3 and 4, a pivot-forming crane element 1 according to the present disclosure is provided for a rotating portion of an element-mounted crane, and this pivot-forming crane element 1 comprises a framework 2 integrating a frame 6 and a truss 7 projecting upwardly of the frame 6 to form a jib-carrier, and this pivot-forming crane element 1 also comprises the following systems which are mounted on the framework 2:

- a motor-driven orienting system 3 comprising a pivot mechanism 31 about an orienting axis Z and at least one orienting electric motor 30 cooperating with the pivot mechanism 31 to make the framework 2 pivot about the orienting axis Z;
- a hoisting winch 4 provided with a hoisting electric motor 40 cooperating with a hoisting drum 41 around which a hoisting rope 42 is wound; and
- a dispensing winch 5 provided with a dispensing electric motor 50 cooperating with a dispensing drum 51 around which a dispensing rope 52 is wound.

Figure 7:
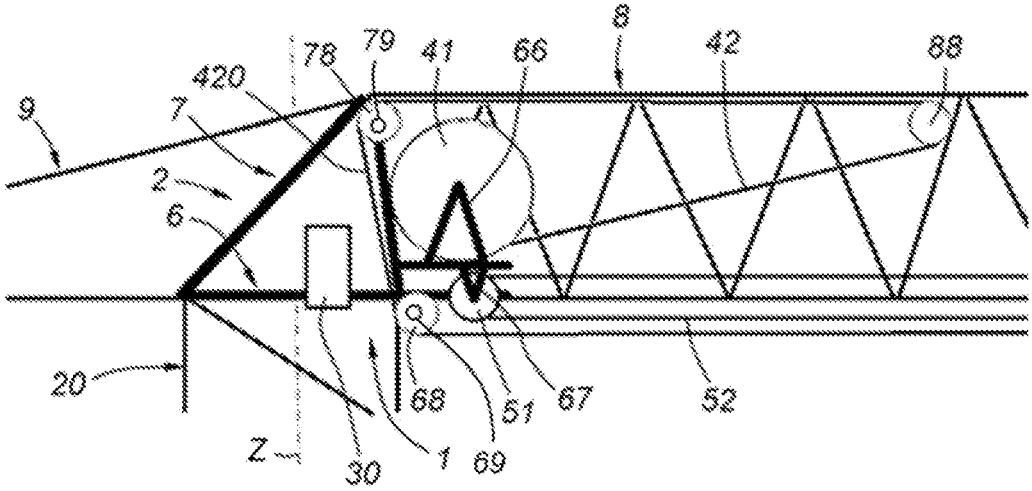
FIG. 7 is a schematic side view illustrating the passage of the hoisting rope in the pivot-forming crane element of FIGS. 3-6.

Once the element-mounted crane is mounted, the latter comprises:

- a rotating portion comprising the pivot-forming crane element 1, as well as a jib-foot forming crane element 8 and a counter-jib forming crane element 9 which are fastened on the framework 2, on either side of the truss 7, and this rotating portion also comprises jib elements (not illustrated) which are assembled successively on the jib-foot forming crane element 8 to form a jib; and
- a mast 20 (schematized only in FIG. 7) provided with a top on which the framework 2 of the pivot-forming crane element 1 is mounted, to enable a rotation of the rotating portion about the orienting axis Z.

Figure 5:
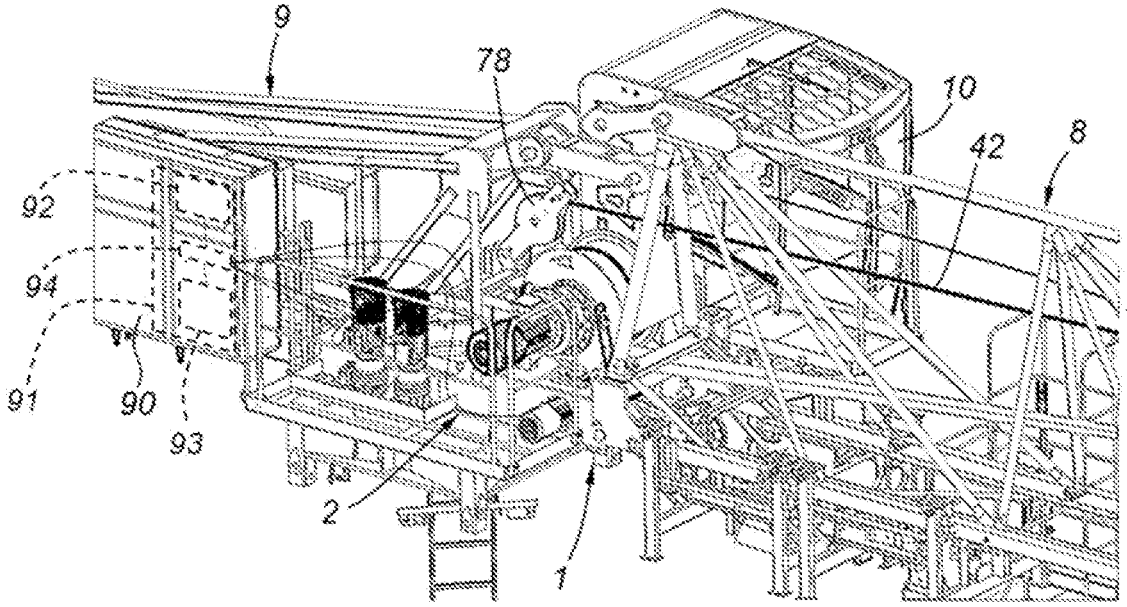
FIG. 5 is a schematic perspective top view of the pivot-forming crane element of FIGS. 3 and 4, where a counter-jib forming crane element is securely fastened on the framework of this pivot-forming crane element and where a jib-foot forming crane element is detachably fastened on this same framework.
Figure 6:
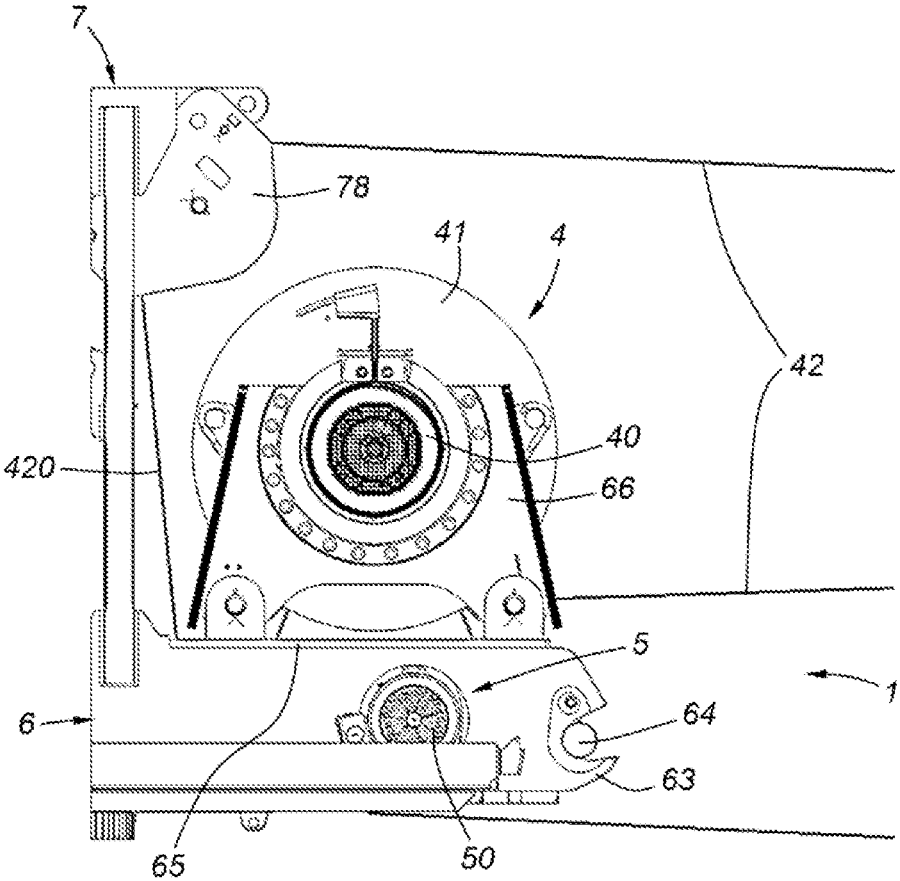
FIG. 6 is a schematic side view of the pivot-forming crane element of FIGS. 3-5.

Thus, the rotating portion of the element-mounted crane comprises the jib formed by an assembly of this jib-foot forming crane element 8 and of the crane elements, with the jib-foot forming crane element 8 which is fastened on the framework 2 of the pivot-forming crane element 1. Moreover, there is provided a dispensing trolley (not illustrated) hanging on the jib and linked to the dispensing winch 5 via the dispensing rope 52 for a displacement of the dispensing trolley along the jib in opposite forward direction and rearward direction. There is also provided a reeve-block (not illustrated) hanging to the dispensing trolley by the hoisting rope 42 coupled to the hoisting winch 4 for a descending and ascending displacement of the reeve-block. As shown in FIG. 5, it could also be considered to mount a control cabin 10 on the framework 2 of the pivot-forming crane element 1. Moreover, one or several counterweight(s) (not illustrated) are mounted on the counter-jib forming crane element 9.

Figure 2:
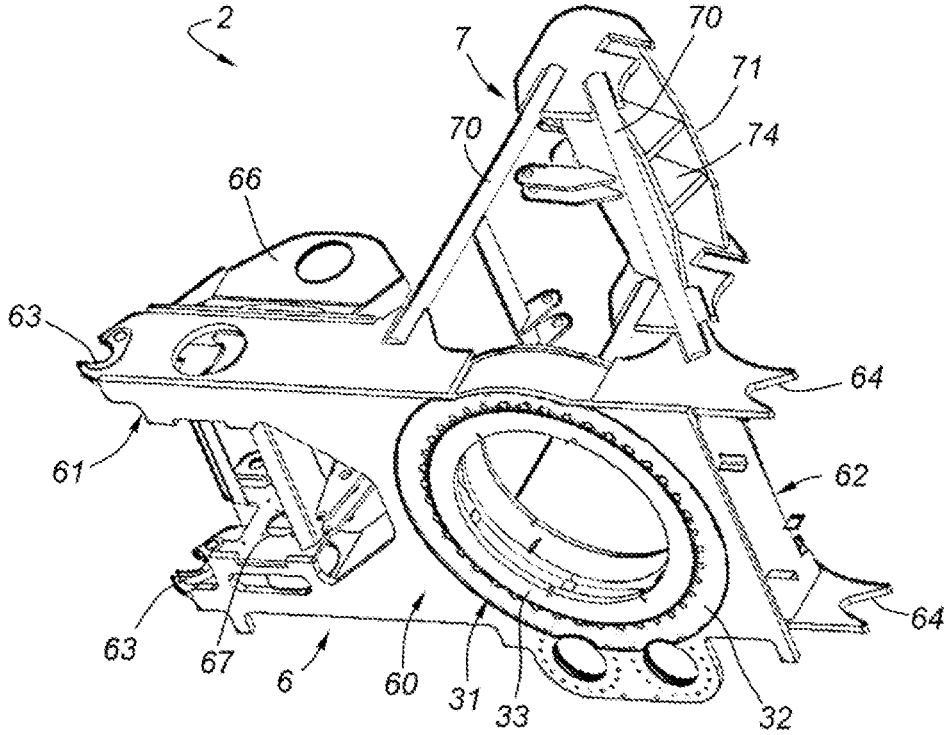
FIG. 2 is a schematic perspective bottom view of the framework of FIG. 1.

Referring to FIG. 2, the pivot mechanism 31 comprises a fixed pivot 32 intended to be securely fastened to the top of the mast 20, and a rotating pivot 33 rotatably coupled to the fixed pivot 32 about the orienting axis Z. The fixed pivot 32 includes an orienting crown which is geared, and the rotating pivot 33 has an annular bearing surface provided on the underside of the framework 2 and bearing on the orienting crown, and the at least one orienting electric motor 30 is provided with a pinion meshing with the orienting crown.

Figure 1:
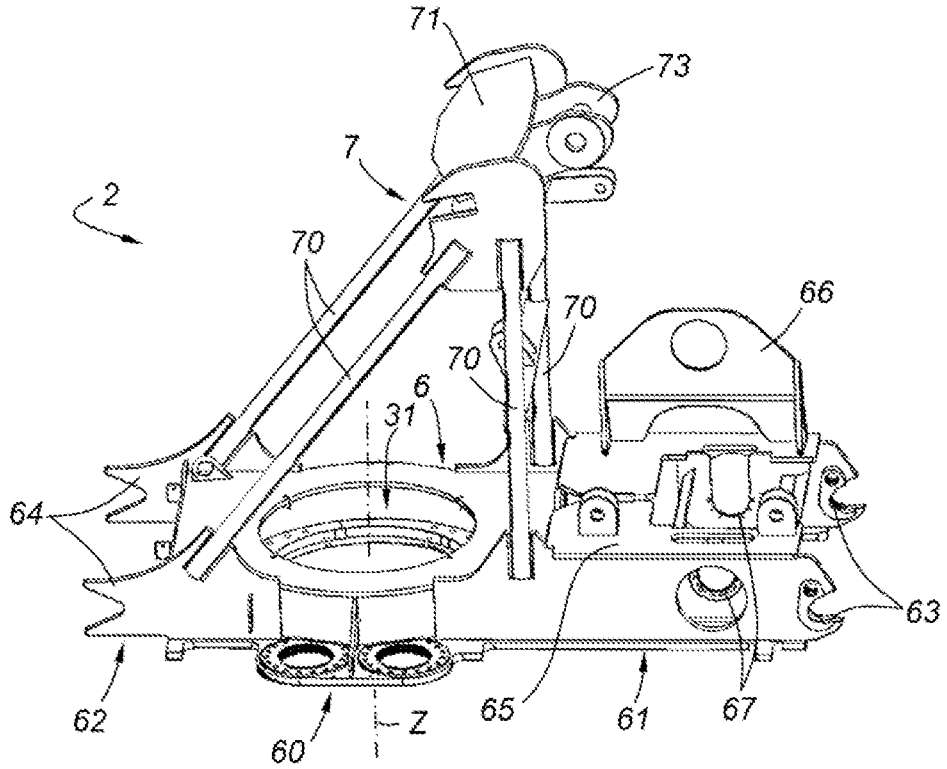
FIG. 1 is a schematic perspective top view of a framework for a pivot-forming crane element according to an embodiment.

Referring to FIGS. 1 and 2, the frame 6 of the framework 2 of the pivot-forming crane element 1 has:

- a central portion 60 on which the motor-driven orienting system 3 and the truss 7 are mounted; and
- a front portion 61 extending the central portion 60 forwards beyond the truss 7, and on which the hoisting winch 4 and the dispensing winch 5 are mounted; and
- a rear portion 62 extending the central portion 60 rearwards beyond the truss 7.

The truss 7 comprises:

- beams 70 projecting upwardly of the frame 6 and each including a lower end secured to the frame 6 and an opposite upper end,
- an upper structure 71 on which the upper ends of the beams 70 are securely fastened.

The truss 7 supports a jib top attachment 73 and the front portion 61 of the frame 6 supports a jib low attachment 63, which are intended to enable a top and low attachment of the jib-foot forming crane element 8 on the framework 2 of the pivot-forming crane element 1. The jib top attachment 73 is provided on the upper structure 71 of the truss 7.

The truss 7 supports a counter-jib top attachment 74 and the rear portion 62 of the frame 6 supports a counter-jib low attachment 64, which are intended to enable a top and low attachment of the counter-jib forming crane element 9 on the framework 2 of the pivot-forming crane element 1. The counter-jib top attachment 74 is provided on the upper structure 71 of the truss 7.

In the illustrated embodiment, it is shown that the front portion 61 of the frame 6 has no rail for the dispensing trolley, so that this front portion 61 does not constitute a jib element. In other words, the dispensing trolley circulates along the jib, and in particular along the jib-foot forming crane element 8, between a jib-foot limit position located on this jib-foot forming crane element 8 and a jib-tip limit position located at the tip of the jib, without said dispensing trolley being able to circulate on the front portion 61 of the frame 6.

Figure 8:
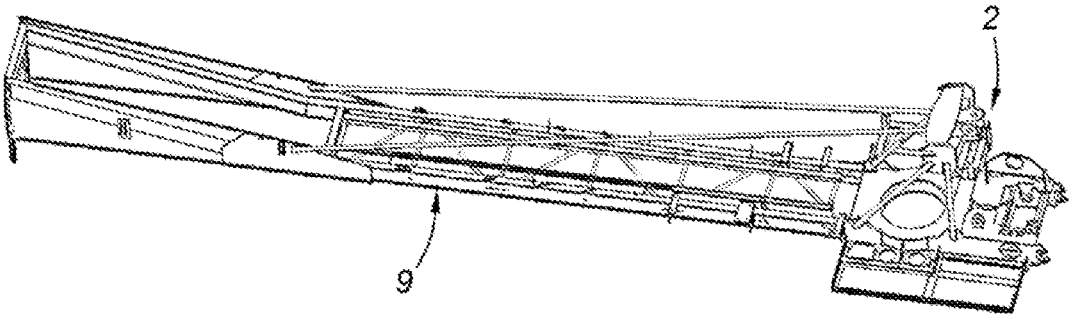
FIG. 8 is a schematic perspective top view of the framework of FIGS. 1 and 2, on which a counter-jib forming crane element is securely fastened to form a transportable package.

In one embodiment as illustrated in FIGS. 3-5 and 8, for example, the jib-foot forming crane element 8 is detachably fastened on the framework 2, whereas the counter-jib forming crane element 9 is securely fastened, by welding, on the framework 2. Thus, the pivot-forming crane element 1 and the counter-jib forming crane element 9 will form together a transportable package which, during the assembly of the element-mounted crane, will be assembled to the mast 20, formed by an assembly of several mast elements, and to the jib-foot forming crane element 8, which is in turn assembled to jib elements to form a jib. FIG. 8 illustrates such a transportable package, where only the framework 2 is represented for the pivot-forming crane element 1.

In this embodiment, the jib top attachment 73 is for example in the form of a bracket intended for a top attachment of the jib-foot forming crane element 8, via a linking pin 80 which enables mounting/dismounting. The jib low attachment 63 comprises two hooks adapted to receive linking shafts 64 intended to assemble at the lower portion the framework 2 and the jib-foot forming crane element 8 and which also enable mounting/dismounting.

In another embodiment that is not illustrated, the counter-jib forming crane element 9 is detachably fastened on the framework 2, whereas the jib-foot forming crane element 8 is securely fastened, by welding, on the framework 2. Thus, in this variant, the pivot-forming crane element 1 and the jib-foot forming crane element 8 form together a transportable package which, during the assembly of the element-mounted crane, will be assembled to the mast 20, formed by an assembly of several mast elements, to the counter-jib forming crane element 9 and to the jib elements to form a jib.

The front portion 61 of the frame 6 comprise an upper bed 65 on which the hoisting winch 4 is mounted, and below which the dispensing winch 5 is mounted, so that the hoisting winch 4 is disposed above the dispensing winch 5. Also, the framework 2 has, securely fastened to the upper bed 65:

- two first bearings 66 mounted on an upper face of the upper bed 65 and on which the hoisting drum 41 is rotatably mounted, and
- two second bearings 67 mounted on a lower face of the upper bed 65 and on which the dispensing drum 51 is rotatably mounted.

It should be noted that the hoisting drum 41 and the dispensing drum 51 are rotatable about parallel axes orthogonal to the orienting axis Z. Also, for routing of the hoisting rope 42 not to be hindered by routing of the dispensing rope 52, and vice versa, the truss 7 supports an upper rope deflection system 78, such as for example an upper pulley, disposed above and at the rear of the hoisting winch 4 for a first deflection of the hoisting rope 42, and the front portion 61 of the frame 6 supports a lower rope deflection system 68, such as for example a lower pulley, disposed below and at the rear of the hoisting winch 4 for a second deflection of the hoisting rope 42.

Thus, the hoisting rope 42 has a rear strand 420 extending between the upper rope deflection system 78 and the lower rope deflection system 68, at the rear of the lifting winch 4. As schematized in FIG. 7, there is also provided a front rope deflection system 88 on the jib-foot forming crane element 8, which is located above and at the front of the hoisting winch 4, so that the hoisting rope 42 passes successively, from the hoisting drum 41, through the front rope deflection system 88, the upper rope deflection system 78, then the front rope deflection system 88 and the dispensing trolley and the reeve-block.

In an embodiment, the at least one upper rope deflection system 78 and the lower rope deflection system 68 is coupled to a load measuring sensor 69, 79 (see FIG. 7) to measure a load at the level of the hoisting rope 42; such a function being thus integrated to the pivot-forming crane element 1.

As shown schematically in FIG. 3, it is advantageous that the pivot-forming crane element 1 also comprises an electric set 91 mounted on the framework 2 (preferably in an electrical cabinet) and integrating at least one command/control unit 92, a power supply interface 93 to plug an electric power supply, and a network of electrical cables 94 connecting the command/control unit 92 and the power supply interface 93 to the orienting electric motor 30, to the hoisting electric motor 40 and to the dispensing electric motor 50. This command/control unit 92 is also connected to a control device (not illustrated) intended for controlling the movements of the crane by a pilot, and in particular a control device disposed in the control cabin 10 and/or alternatively a remote control device or a radio-control device.

In one variant, this electric set 91 is mounted on the main crane element, selected amongst the counter-jib forming crane element 9 and the jib-foot forming crane element 8, to form, with the pivot-forming crane element 1, a transportable package. Thus, in the example illustrated in FIG. 5, the electric set 91 (shown schematically) is mounted on the counter-jib forming crane element 9 inside an electrical cabinet 90.

This command/control unit implements:

- the reception, at the input, of the signal for controlling the movements of the crane, such as hoisting, rotation, dispensing and translation, originating from the control device, and also receives at the input signals originating from different sensors (such as for example position sensors, load measuring sensor such as that described hereinabove, a sensor for measuring the state of the brake(s) associated to all or part of the movements of the crane, a sensor for measuring the horizontality of a portion of the crane, such as an inclinometer, a wind sensor such as an anemometer) and/or safety systems, and
- the output of start and stop orders, by monitoring the action of the speed drives or other control members assigned to the movements and in particular to the motor-driven orienting system 3, the hoisting winch 4 and the dispensing winch 5, as well as the action of the possible safety devices of the crane (such as for example a general shutdown actuator).

In an embodiment, at least one anemometer (not illustrated) is mounted on the framework 2 and is connected to the command/control unit.

Further, in an embodiment, a hoisting safety device (not illustrated), such as top and bottom end-of-travels, is disposed on the hoisting winch 4 to secure the travel of the hoisting rope 42 and is connected to the command/control unit. Similarly, a dispensing safety device (not illustrated), such as front and rear end-of-travels, is disposed on the dispensing winch 5 to secure the travel of the dispensing rope 52 and is connected to the command/control unit.

Thus, most of the electrical wirings and electrical tests shall be done directly on the pivot-forming crane element 1, in the factory, even before the assembly of the crane on the construction site.

The invention claimed is:

1. A pivot-forming crane element for a rotating portion of an element-mounted crane, the pivot-forming crane element comprising:

- a framework on which are mounted:
  - a motor-driven orienting system comprising a pivot mechanism about an orienting axis and at least one orienting electric motor cooperating with the pivot mechanism to make the framework pivot about the orienting axis;
  - a hoisting winch provided with a hoisting electric motor cooperating with a hoisting drum around which a hoisting rope is wound; and a dispensing winch provided with a dispensing electric motor cooperating with a dispensing drum around which a dispensing rope is wound, wherein the framework comprises a frame and a truss projecting from the frame to form a jib carrier, wherein all of the motor-driven orienting system, the hoisting winch and the dispensing winch are mounted on the frame; the frame having:

a central portion on which the motor-driven orienting system and the truss are mounted; and a front portion extending the central portion forwards beyond the truss, and on which the hoisting winch and the dispensing winch are mounted, wherein the front portion includes an upper bed on which the hoisting winch is mounted, and below which the dispensing winch is mounted, so that the hoisting winch is disposed above the dispensing winch, and wherein the truss supports a jib top attachment and the front portion of the frame supports a jib low attachment.

2. The pivot-forming crane element according to claim 1, wherein the front portion of the frame does not have any rail for a dispensing trolley, so that the front portion does not constitute a jib element.

3. The pivot-forming crane element according to claim 1, wherein the hoisting drum and the dispensing drum are rotatable about parallel or substantially parallel axes.

4. The pivot-forming crane element according to claim 1, wherein the truss supports an upper rope deflection system disposed above and at the rear of the hoisting winch for a first deflection of the hoisting rope, and the front portion of the frame supports a lower rope deflection system disposed below and at the rear of the hoisting winch for a second deflection of the hoisting rope.

5. The pivot-forming crane element according to claim 4, wherein at least one amongst the upper rope deflection system and the lower rope deflection system is coupled to a load measuring sensor to measure a load at the level of the hoisting rope.

6. The pivot-forming crane element according to claim 1, wherein the frame has a rear portion extending the central portion rearwards beyond the truss, and the truss supports a counter-jib top attachment and the rear portion of the frame supports a counter-jib low attachment.

7. The pivot-forming crane element according to claim 1, wherein the framework has at least one first bearing on which the hoisting drum is rotatably mounted, and at least one second bearing on which the dispensing drum is rotatably mounted.

8. The pivot-forming crane element according to claim 1, further comprising an electric set mounted on the framework and integrating at least one command/control unit, a power supply interface to plug an electric power supply, and a network of electrical cables connecting the command/control unit and the power supply interface to the orienting electric motor, to the hoisting electric motor and to the dispensing electric motor.

9. A transportable package for a rotating portion of an element-mounted crane, the transportable package comprising:

the pivot-forming crane element according to claim 1, and a main crane element, selected amongst a counter-jib forming crane element and a jib-foot forming crane element, fastened on the framework of the pivot-forming crane element.

10. The transportable package according to claim 9, wherein the main crane element is securely fastened on the framework of the pivot-forming crane element.

11. The transportable package according to claim 9, further comprising an electric set mounted on the main crane and integrating at least one command/control unit, a power supply interface to plug an electric power supply, and a network of electrical cables connecting the command/control unit and the power supply interface to the orienting electric motor, to the hoisting electric motor and to the dispensing electric motor.

12. A rotating portion of an element-mounted crane, comprising the transportable package according to claim 9, and further comprising a secondary crane element, selected amongst the counter-jib forming crane element and the jib-foot forming crane element and which is not the main crane element, detachably fastened on the framework of the pivot-forming crane element.

13. An element-mounted crane comprising:

the rotating portion according to claim 12; and a mast provided with a top on which the framework of the pivot-forming crane element is mounted.

14. The element-mounted crane according to claim 13, further comprising:

a jib provided with the jib-foot forming crane element fastened on the framework of the pivot-forming crane element;

a dispensing trolley hanging on the jib and linked to the dispensing winch via the dispensing rope for a displacement of the dispensing trolley along the jib in opposite forward direction and backward direction;

a reeve-block hanging from the dispensing trolley by the hoisting rope coupled to the hoisting winch for an ascending and descending displacement of the reeve-block.

15. A pivot-forming crane element for a rotating portion of an element-mounted crane, the pivot-forming crane element comprising:

a framework on which are mounted:

a motor-driven orienting system comprising a pivot mechanism about an orienting axis and at least one orienting electric motor cooperating with the pivot mechanism to make the framework pivot about the orienting axis;

a hoisting winch provided with a hoisting electric motor cooperating with a hoisting drum around which a hoisting rope is wound; and a dispensing winch provided with a dispensing electric motor cooperating with a dispensing drum around which a dispensing rope is wound, wherein the framework comprises a frame and a truss projecting from the frame to form a jib carrier, wherein all of the motor-driven orienting system, the hoisting winch and the dispensing winch are mounted on the frame; the frame having:

a central portion on which the motor-driven orienting system and the truss are mounted; and a front portion extending the central portion forwards beyond the truss, and on which the hoisting winch and the dispensing winch are mounted, wherein the front portion includes an upper bed on which the hoisting winch is mounted, and below which the dispensing winch is mounted, so that the hoisting winch is disposed above the dispensing winch, and wherein the frame has a rear portion extending the central portion rearwards beyond the truss, and the truss supports a counter-jib top attachment and the rear portion of the frame supports a counter-jib low attachment.

16. A transportable package for a rotating portion of an element-mounted crane, the transportable package comprising:

the pivot-forming crane element according to claim 15, and a main crane element, selected amongst a counter-jib forming crane element and a jib-foot forming crane element, fastened on the framework of the pivot-forming crane element.

17. A rotating portion of an element-mounted crane, comprising the transportable package according to claim 16, and further comprising a secondary crane element, selected amongst the counter-jib forming crane element and the jib-foot forming crane element and which is not the main crane element, detachably fastened on the framework of the pivot-forming crane element.

18. An element-mounted crane comprising:

the rotating portion according to claim 17; and a mast provided with a top on which the framework of the pivot-forming crane element is mounted.

19. A pivot-forming crane element for a rotating portion of an element-mounted crane, the pivot-forming crane element comprising:

a framework on which are mounted:

a motor-driven orienting system comprising a pivot mechanism about an orienting axis and at least one orienting electric motor cooperating with the pivot mechanism to make the framework pivot about the orienting axis;

a hoisting winch provided with a hoisting electric motor cooperating with a hoisting drum around which a hoisting rope is wound; and a dispensing winch provided with a dispensing electric motor cooperating with a dispensing drum around which a dispensing rope is wound, wherein the framework comprises a frame and a truss projecting from the frame to form a jib carrier, wherein all of the motor-driven orienting system, the hoisting winch and the dispensing winch are mounted on the frame; the frame having:

a central portion on which the motor-driven orienting system and the truss are mounted; and a front portion extending the central portion forwards beyond the truss, and on which the hoisting winch and the dispensing winch are mounted, wherein the front portion includes an upper bed on which the hoisting winch is mounted, and below which the dispensing winch is mounted, so that the hoisting winch is disposed above the dispensing winch, and wherein the truss supports an upper rope deflection system disposed above and at the rear of the hoisting winch for a first deflection of the hoisting rope, and the front portion of the frame supports a lower rope deflection system disposed below and at the rear of the hoisting winch for a second deflection of the hoisting rope.

* * * * *